US005558004A

United States Patent [19]

Stellwagen

[11] Patent Number: 5,558,004

[45] Date of Patent: Sep. 24, 1996

[54] CONTROL ARRANGEMENT FOR AT LEAST ONE HYDRAULIC CONSUMER

[75] Inventor: Armin Stellwagen, Lohr/Main, Germany

[73] Assignee: Mannesmann Rexroth GmbH, Lohr/Main, Germany

[21] Appl. No.: 373,315

[22] PCT Filed: Jun. 30, 1993

[86] PCT No.: PCT/EP93/01680

§ 371 Date: Jan. 13, 1995

§ 102(e) Date: Jan. 13, 1995

[87] PCT Pub. No.: WO94/02743

PCT Pub. Date: Feb. 3, 1994

[30] Foreign Application Priority Data

Jul. 16, 1992 [DE] Germany ..... 42 23 389.5

[51] Int. Cl.[6] ..... F15B 11/05

[52] U.S. Cl. ..... 91/517; 91/447; 91/465

[58] Field of Search ..... 91/445, 446, 447, 91/465, 517; 60/422, 426

[56] References Cited

U.S. PATENT DOCUMENTS

| | | | |
|---|---|---|---|
| 4,145,958 | 3/1979 | Ille . | |
| 4,716,933 | 1/1988 | Stoever et al. . | |
| 5,005,358 | 4/1991 | Hirata et al. | 60/426 |
| 5,207,059 | 5/1993 | Schexnayder | 91/445 X |
| 5,220,862 | 6/1993 | Schexnayder | 91/445 X |
| 5,251,444 | 10/1993 | Ochiai et al. | 60/426 X |

FOREIGN PATENT DOCUMENTS

| | | |
|---|---|---|
| 0230529 | 8/1987 | European Pat. Off. . |
| 3128044 | 2/1983 | Germany . |
| 3221160 | 12/1983 | Germany . |
| 3413866 | 11/1984 | Germany . |
| 3334094 | 4/1985 | Germany . |
| 3434014 | 3/1986 | Germany . |
| 3505623 | 8/1986 | Germany . |
| 3634728 | 10/1986 | Germany . |
| 3640640 | 6/1988 | Germany . |
| 2147053 | 5/1985 | United Kingdom . |
| 2195745 | 4/1988 | United Kingdom . |

OTHER PUBLICATIONS

Backe, W.: Hydraulische Schaltungstechnik, 2, Edition, 1976, RWTH Aachen, pp. 45–48.

Rose, M,: Weniger Energie—mehr Leistung. In: O+p–ölhydraulik und pneumatik, 28/1984,No. 12, pp. 758–759.

*Primary Examiner*—John E. Ryznic

*Attorney, Agent, or Firm*—Martin A. Farber

[57] ABSTRACT

A control arrangement for at least one hydraulic consumer in which the consumer can be controlled with respect to direction and speed via a directional control valve device, in which two consumer lines lead from the directional control valve device to the consumer, each of which consumer lines can be connected to a pump and a tank respectively via a directional control valve piston and a metering restrictor and in which a throttle valve having a servo-piston is associated with each consumer line. The consumer is to be held free of leakage oil in a given position. This is achieved in the manner that the servo-piston of the throttle valve is arranged downstream of the directional control valve piston and the metering restrictor in the consumer line, that a valve seat can be acted on by the servo-piston, that the servo-piston has at its front a first pressure surface which can be acted on for the opening of the throttle valve by the pressure prevailing downstream of the directional control valve device and the metering restrictor in the corresponding consumer line, at its rear a pressure surface which can be acted on, for the closing of the throttle valve, by a control pressure which, in the position of rest of the directional control valve piston, is generated solely by the load, and at its front a third pressure surface which, for an opening of the throttle valve, can be acted on by the load pressure prevailing in the corresponding consumer line between throttle valve and consumer, and that upon a discharge of the corresponding consumer line to the tank, the pressure acting on the second pressure surface can be reduced.

32 Claims, 6 Drawing Sheets

CONTROL ARRANGEMENT FOR AT LEAST ONE HYDRAULIC CONSUMER

This application is a Rule 371 of PCT/EP93/01680 filed Jun. 30, 1993.

FIELD AND BACKGROUND OF THE INVENTION

The present invention relates to a control arrangement for at least one hydraulic consumer. Control arrangements are used in particular for mobile machines such as excavators, wheel loaders, or automotive cranes, From Federal Republic, of Germany 36 34 728 A1 a control arrangement is already known in which the consumer can be controlled in direction and speed via a directional control device and in which two consumer lines lead to the consumer from the directional control valve device, each of which consumer lines can be connected via a directional control valve piston and a metering restrictor to a pump and/or via the directional control valve piston to a tank. The metering restrictor is formed by fine control grooves on an annular collar of the directional control valve piston by means of which grooves the speed of the consumer can be controlled. A throttle valve having a servo-piston is arranged between the metering restrictor and the sections of the directional control valve piston which serve for the directional control. In the position of rest of the directional control valve piston, the consumer lines are blocked off from the tank by the directional control valve piston. The sealing is effected along a slot between the piston and the housing which contains the piston. This sealing is not complete so that leakage losses occur in the consumer lines and may lead to movement of the consumer and thus to a change in the position of the implements of a machine moved with this hydraulic consumer.

From Federal Republic of Germany 34 13 866 A1 a control arrangement for a hydraulic consumer is known in which a throttle valve having a servo-piston is arranged in each consumer line. Structurally, the arrangement is such that the servo-piston of a throttle valve is present in a bore in the directional control valve piston, which can thus be considered a housing of the throttle valve. In a switch position in which the corresponding consumer line is connected to the pump, hydraulic fluid flows from an annular channel in the directional control valve device via bore holes into the inside of the directional control valve piston, and there, via the throttle valve and other bore holes, out of the inside of the directional control valve piston outward into a further annular channel from which the consumer line extends. In the position of rest of the valve piston, the two annular channels as well as a third annular channel which is connected to the tank are sealed off by the narrow slot between the directional control valve piston and the housing of the directional control valve. Thus, also in the control arrangement known from Federal Republic of Germany 34 13 866A1, a consumer line is not blocked off free of leakage so that the consumer can change its position.

SUMMARY OF THE INVENTION

The object of the present invention is so to develop a control arrangement which is provided for at least one hydraulic load, of the above type, and has the features set forth that the blocking-off of the consumer lines to be free of leakage oil is improved so that the consumer reliably retains its position when the directional control valve device is in its position of rest.

This object is achieved in accordance with the invention by a control arrangement of the above type wherein the servo-piston of the throttle valve is initially arranged downstream of the directional control valve piston and of the metering restrictor in the consumer line. Downstream here means that a hydraulic fluid first of all flows through the flow-dividing valve device and the metering restrictor and only then through the throttle valve when the corresponding consumer line is connected with the pressure connection of the pump. Furthermore, the throttle valve is developed as a seating-type valve and has a servo-piston which acts on a valve seat. By means of the throttle valve, the consumer line can thus be sealed off free of leakage. The servo-piston of the throttle valve is now provided with various surfaces which can be so acted on by pressure that the servo-piston opens when the consumer line is acted on by pressure via the directional control valve device from the pump, that the servo-piston also opens when hydraulic fluid is to flow back via the consumer line from the consumer to the tank, and that the servo-piston sits on the valve seat when the directional control valve piston is in a position of rest. The servo-piston has at the front a first pressure surface which can be acted on for the opening of the throttle valve by the pressure prevailing downstream of the directional control valve device and of the metering restrictor in the corresponding consumer line. At its rear, the servo-piston of the throttle valve has a pressure surface which can be acted on for the closing of the throttle valve by a control pressure produced solely by the load in the position of rest of the directional control valve piston. Finally, the servo-piston of the throttle valve has a third pressure surface which can be acted on for the opening of the throttle valve by the load pressure prevailing in the corresponding consumer line between throttle valve and consumer. The force produced by the action of the load pressure on this third pressure surface should open the throttle valve when the consumer line is discharged towards the tank. In order to achieve this opening, the pressure acting on the rear pressure surface can be reduced upon such a discharge of the corresponding consumer line to the tank. In the position of rest of the directional control valve piston, a force is produced on the rear pressure surface which counteracts the pressure prevailing on the third pressure surface and permits the closing of the throttle valve in the position of rest of the directional control valve piston. In the position of rest of the directional control valve piston, the throttle valve thus seals off the consumer line free of leakage oil. On the other hand, the consumer can be fed by the pump and discharged towards the tank.

The invention also provided a particular preferred development which is beneficial in cases in which a part of a mobile implement is movable by the load and therefore, for instance, upon the lowering of the shovel of a wheel loader, a load-compensated lowering is possible.

In accordance with a feature of the invention, the servo-piston has a cylindrical section with at least one fine control groove. In this way, a fine throttling of the stream of fluid is possible.

Modern control arrangements for mobile implements are very frequently developed in such a manner that, in the event of a pump delivery which is not sufficient for all the consumers which have been actuated, all the consumers are fed with a smaller delivery percentage and therefore move more slowly by the same percentage in the same position of the directional control valve piston. For this purpose, the highest load pressure is determined and applied to the throttle valves of the different consumers which act as a pressure compensator. A control which is compensated for load pressure is thus also possible, i.e., the speed of the consumer remains constant for a given position of the metering restrictor regardless of the load. In order to obtain these functions, it is now provided in a control arrangement in accordance with the invention, that the control pressure and therefore the pressure acting on the rear second pressure surface of the servo-piston of the throttle valve is generated in accordance with the sizes of the first, second and third pressure surfaces in such a manner from the load pressure of the corresponding consumer and the highest load pressure of several consumers that an equilibrium of forces between the forces acting on the first and third pressure surfaces on the one hand, and those acting on the second pressure surface on the other hand, can be established on the servo-piston. The control pressure can advantageously be generated in the manner that a control space limited by the third pressure surface is connected via a first nozzle with a line acted on by the load pressure and, via a second nozzle, with a line acted on by the maximum load pressure. By means of the nozzles, a control pressure is generated which lies between the load pressure of the corresponding consumer and the highest load pressure, or corresponds to the load pressure if the load pressure of the specific consumer is the highest load pressure. If, in the position of rest of the directional control valve piston, the highest load pressure is not present on the side of the second nozzle facing away from the control space, but this side is rather blocked off, the pressure in the control space corresponds to the load pressure of the corresponding consumer. In order that the viscosity of the hydraulic fluid does not have an effect on the control pressure, it is favorable if, in accordance with another development of the invention the first pressure surface and the second pressure surface are of the same size and the first nozzle and the second nozzle are two identical nozzles. Naturally, the manufacture of the control device is also simplified thereby and one source of error is removed.

The invention also provides another embodiment of a servo-piston of the throttle valve. It is stepped not only on its front end but also on its rear end and has a second pressure surface and a fourth pressure surface there. The fourth pressure surface is as large as the third pressure surface and can be acted on by the load pressure for the closing of the throttle valve. The control space behind the fourth pressure surface can be connected via a nozzle with the section of the consumer line present between the throttle valve and the consumer. This permits a discharge of this control space upon a discharge of the consumer line. On the other hand, when the consumer line is connected with the pressure connection of the pump, the servo-piston can be balanced with respect to the load pressure. The second pressure surface is as large as the first pressure surface and can be acted on by the maximum load pressure. In this way, the maximum load pressure is established also in front of the throttle valve. As in the case of a servo-piston with only a rear pressure surface, the pressure drop over the metering restrictor and thus the speed of the consumer are in this case also independent of the load.

Both in the case of a servo-piston with only a rear pressure surface and in the case a servo-piston having two rear pressure surfaces, a compression spring can be provided which urges the servo-piston in the direction of the closing of the throttle valve. One is then independent of the position in which the throttle valve is installed. Also, in the embodiment with the double-stepped servo-piston in which the load pressure is after all balanced, it is seen to it that the servo-piston is pressed with a certain force against the valve seat when the directional control valve piston is in its position of rest.

The invention also provides embodiments which relate to how a control space behind the servo-piston can be discharged in advantageous manner and how load compensation is also obtained in advantageous manner in the event that the consumer is displaced by the load Thus, in accordance with one embodiment a control space behind the servo-piston can be discharged via an openable non-return valve which, in closed condition, blocks off the control space free of leakage oil. For the opening, the non-return valve is advantageously controlled by a control pressure for a hydraulically displaceable directional control valve piston or by the pump pressure, which, however, for instance upon the lowering of a load, may be substantially less than the pressure present in the control space upon the raising of the load. Therefore, in accordance with another embodiment, the closure element of the non-return valve can be lifted from the valve seat by an auxiliary piston which has a control surface which can be acted on by control pressure and is substantially larger than the blocking surface on the closure element. By blocking surface, there is meant the surface on the closure element which is exposed to the control pressure in the control space in the sense of a closing of the non-return valve. According to still another embodiment the control space behind the control surface of the auxiliary piston can be discharged towards the tank in the position of rest of the directional control valve device so that the non-return value is reliably closed.

In order that the consumer can be lowered with the same speed and therefore in load-compensated manner regardless of the height of the load in a given position of the directional control valve piston or pistons, a pressure compensator is provided, in accordance with a feature of the invention, between the non-return valve and a section of the consumer line located between the directional control valve device and the throttle valve, the control piston of which control compensator can be acted on in the one direction by the pressure in the section of the consumer line and is acted on in the other direction on by a spring. The pressure in the section of the consumer line corresponds upon discharge of the hydraulic fluid to the pressure in front of the measuring restrictor of the directional control valve device, while the control piston is exposed on the other side merely to the tank pressure which ordinarily prevails behind the metering restrictor. The pressure compensator therefore, in a given position of the directionaL control valve piston, maintains the pressure drop over the metering restriction constant and thus the volumetric flow of the hydraulic fluid is constant regardless of the height of the load. The pressure compensator can be referred to as pre-control pressure compensator for the throttle valve and changes the pressure in its control space in such a manner that the pressure drop over the throttle valve varies as a function of the height of the load, in such a manner that the pressure drop over the metering restrictor is constant.

For the feeding of the highest load pressure into a load signal line, instead of using a shuttle valve chain, a load signal valve is preferably used in accordance with a development of the invention permitting the generating of a load signal without oil being removed from the consumer line between the throttle valve and the consumer. Such load signal valves are known per se. In a control arrangement in accordance with the invention, a load signal valve is associated with one or, with the aid of shuttle valves, both consumer lines and has a work input which can be connected between the directional control valve device and the throttle valve to a consumer line, is connected by a work output to a load signal line, is connected by a first control input between throttle valve and consumer to the consumer line, and is connected by a second control input to the load signal line. In order, when the consumer is stopped, to have fewer leakage oil losses from the first control input via a valve spool of the load signal valve to the tank, the valve spool is advisedly so developed in accordance with a feature of the invention, with it, the first control input can be shut off in the manner of a seating-type valve from the work connections of the load signal valve. In the case of a single seat, the shutting off is advantageously so developed that the valve spool can be pressed against the seat by the load pressure of the consumer. It will then be blocked off when the load pressure of the stopped consumer is greater than the greatest load pressure of the consumer which is just moved or if all consumers are at rest so that no pressure is present in the load signal line. With a double seat, the result can be obtained that blocking can be effected even if the highest load pressure of the consumer which is just moved is greater than the load pressure of the consumer at rest. Very slight losses of leakage oil occur when the highest load pressure of the consumer which is just moved drops below the load pressure of the consumer at rest, or vice versa, and the valve spool changes from one seat to the other seat. It also appears particularly favorable if, in the connection leading over the load signal valve from the consumer line to the load signal line, a non-return valve is arranged which blocks the path towards the consumer line. This non-return valve prevents losses from the load signal line to the tank via the directional control valve device, when the consumer is unactuated but its load pressure is greater than the highest load pressure of the actuated consumers and the load signal value thus is set for passage. In particular, the development of the valve spool of the load signal valve as a seating-type valve free of leakage oil can also be employed to advantage independently of features referred to above.

The highest load pressure necessary in order to control the servo-piston of the throttle valve is preferably not taken directly from the load-signal line but, in accordance with a feature of the invention is generated by means of a copy valve. This valve is connected by a work input between the directional control valve device and the throttle valve to a consumer line and by a work output to a control space behind the servo-piston of the throttle valve. In this way, no pressure is present at the work output of the copy valve when the section of the consumer line between the throttle valve device and the directional control valve device is discharged via the latter towards the tank. A first control input at which the copy valve can be acted on by pressure in opening direction is connected to the load signal line, while the second control input is connected to the work output or coincides with it. In this way, the pressure at the work output of the copy valve cannot become higher than the highest load pressure. In order that when the consumer is unactuated, the consumer line does not gradually run empty via the copy valve when the latter is open, since the load pressure of the consumer is less than the highest pressure of the actuated consumer, a non-return valve is advantageously arranged in the connection from the consumer line to the control space behind the servo-piston of the throttle valve. This can possibly be the same non-return valve as the one which, in the connection between the consumer line and the load signal line, is intended to prevent hydraulic fluid flowing out of the load signal line via the load signal valve, which is set for passage, to the directional control valve device and via the latter to the tank. If the non-return valve, however, in advantageous manner, is also to assume the additional function of preventing leakage oil losses from the consumer line, which could occur due to an incomplete sealing between the valve spool of the copy valve and the housing which receives said spool in a bore hole, the non-return valve is, in accordance with another feature of the invention arranged in the connection between the valve spool and a control space behind the servo-piston of the throttle valve. The seat for the movable valve body of the non-return valve should in this connection not be on the valve spool.

The expense for the arrangement of the load signal valve and the copy valve is slight if the valve spool of the load signal valve and the valve spool of the copy valve are contained in the same housing bore and the load signal line, to which both valves are connected by a control or work input, is connected between the two valve spools to the housing bore. The depth of immersion of the valve spool into the bore is advantageously limited in each case by a head of larger diameter.

Several embodiments of a control arrangement in accordance with the invention are shown in the drawings.

BRIEF DESCRIPTION OF THE DRAWINGS

With the above and other advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
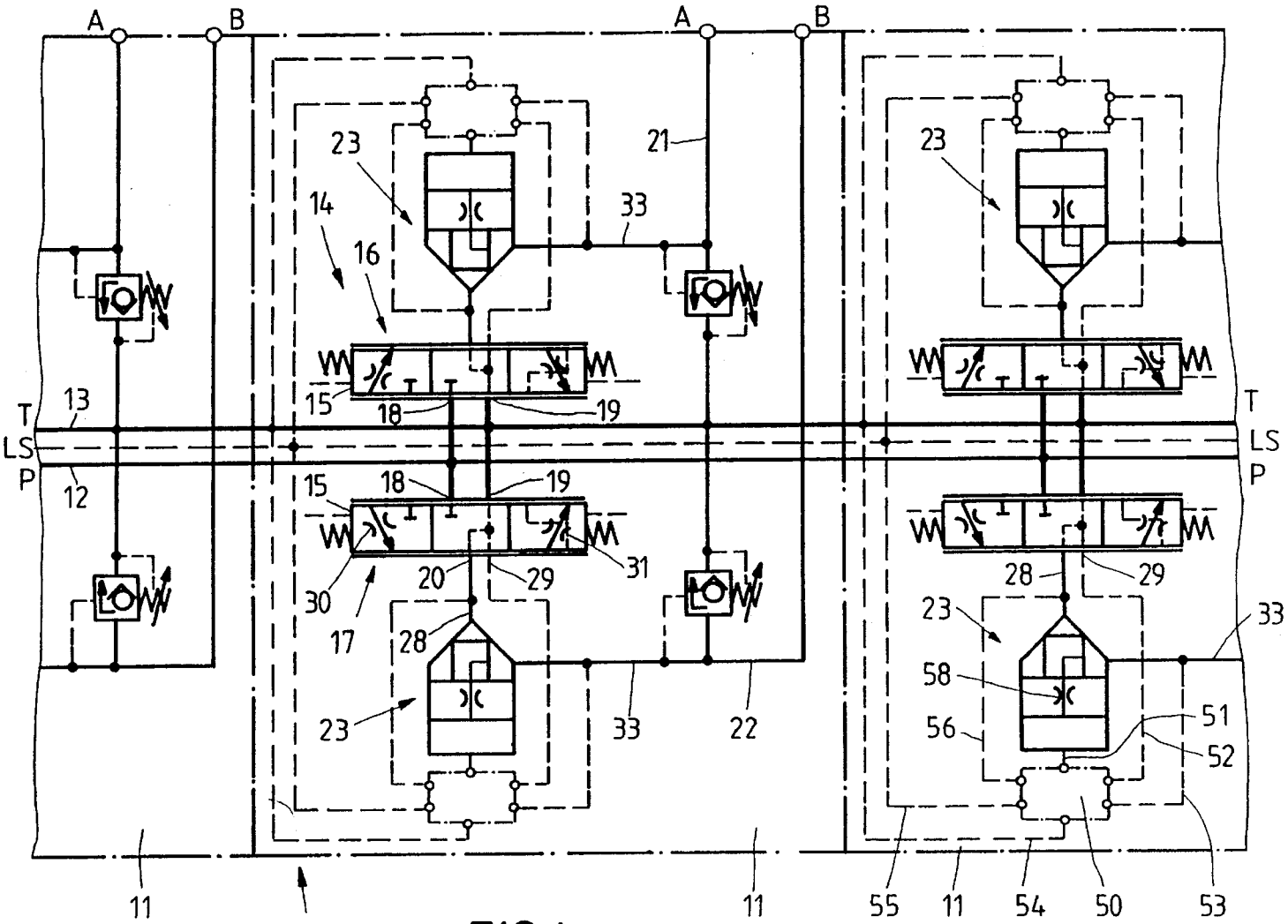
FIG. 1 is an overall view of a circuit diagram for a control arrangement in accordance with a first embodiment, intended for several hydraulic consumers.

Within a housing block 10 which is made in one piece or laminated from several parts and has several valve sections 11 of identical construction, a pump line 12 and a tank line 13 as well as a load signal line (LS) 57 extend between all sections. In each section 11, a directional control valve device 14 is arranged, which, in accordance with FIG. 1, has, for each side A and B of the hydraulic consumer controlled by the corresponding section, a directional control valve piston 15 which is displaceable hydraulically against the force of a compression spring from a central position of rest toward both sides and which can be viewed accordingly as assembled from two directional control valves 16 and 17. Each directional control valve has a work input 18 which is connected to the pump line 12, and a work input 19 which is connected to the tank line 13. Consumer lines 21 and 22 extend to the side A and B respectively of the consumer from a work output 20 of each directional control valve.

A throttle valve 23, the construction and function of which will be described later, is arranged in each consumer line.

Figure 5:
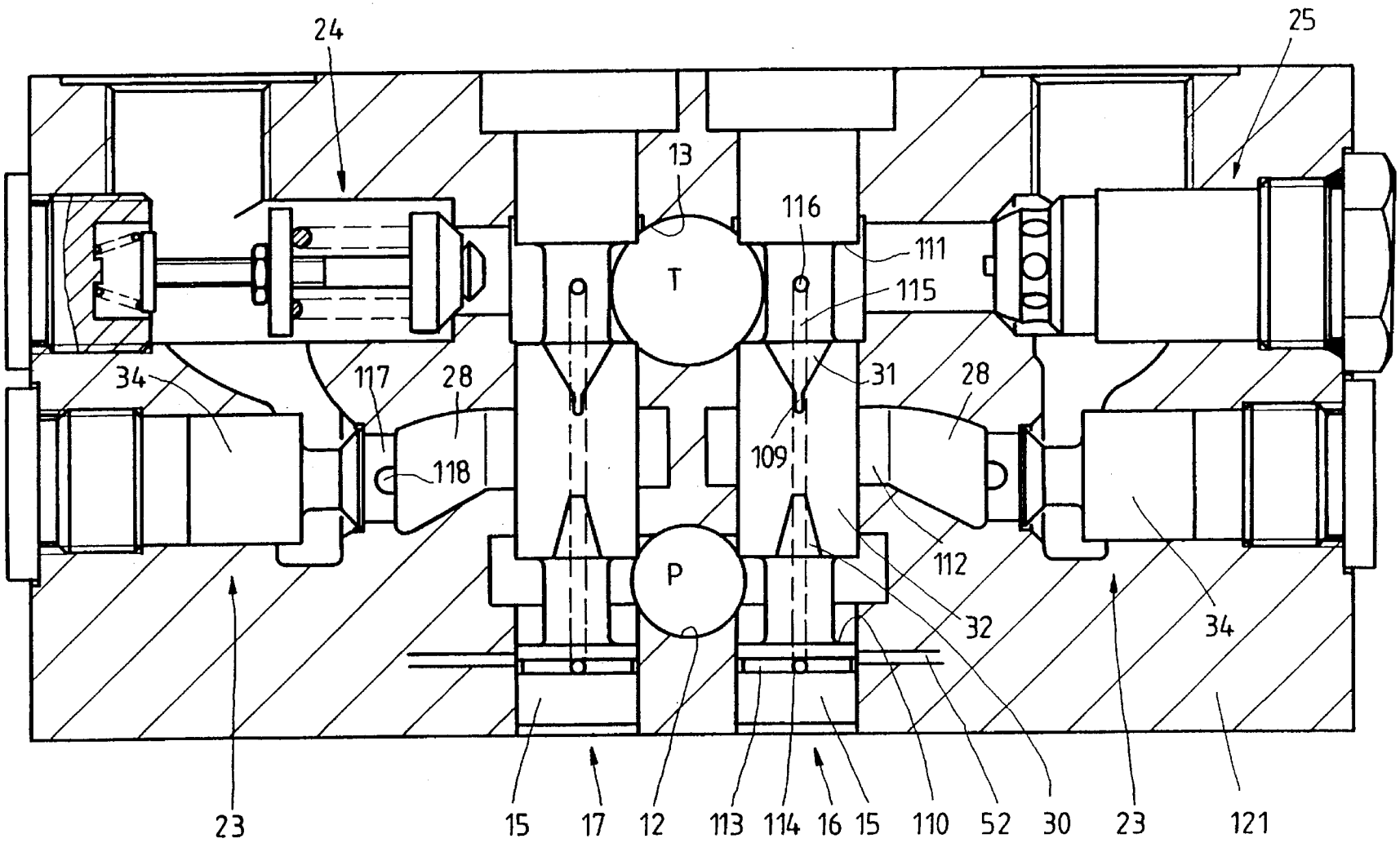
FIG. 5 shows the spatial development of a valve section for an individual hydraulic consumer of the several consumers of FIG. 1.
Figure 6:
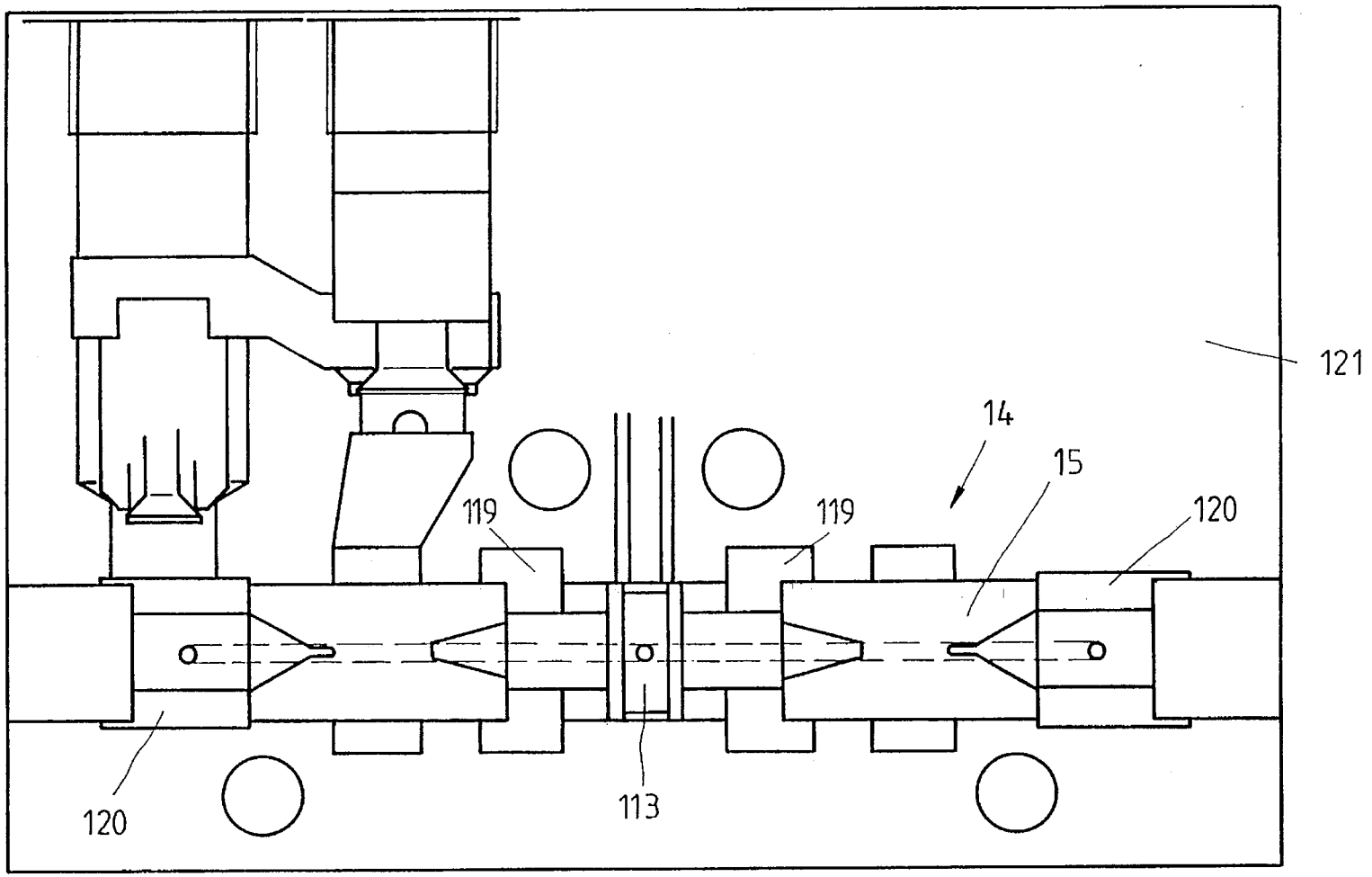
FIG. 6 shows another valve block with a single valve spool of the flow-dividing valve device for both consumer lines of a hydraulic consumer.

In the central position of a directional control valve piston 15, the section 28 of a consumer line is discharged to the tank between the throttle valve 23 and a directional control valve. The work input 18 is blocked. If a directional control valve piston 15 is pushed to the right in the showing of FIG. 1, the work input 18 and the work output 20 of a directional control valve are connected with each other. The work input 19 is blocked. Upon a displacement of a directional control valve piston to the left, the work input 19 is connected with the work output 20. The work input 18 is connected with a control output 29. In a connection between a work input and the work output, there is inserted in each case a metering restrictor 30 and 31 respectively which, as can be noted from FIG. 5, is produced by fine control 30, 31 respectively on an annular collar 32 of a directional control valve piston 15. In the middle position of a directional control valve piston 15 the control output 29 is discharged to the tank in addition to the work output 20. The two directional control pistons 15 of the directional control valves 16 and 17 are in each case displaced jointly, but in opposite direction. Upon actuation therefore, the work output 20 of the one directional control valve is connected to the tank and the work output 20 of the other direction control valve is connected to the pump.

A combined pressure-limiting and after-suction valve is connected on the section 33 between the throttle valve 23 and the consumer of each consumer line 21 or 22 and is furthermore connected to the tank line 13.

Each throttle valve 23 has a displaceable servo-piston 34 which has a single step, in the embodiments of FIGS. 1 to 6, its stepped end facing a conical surface 35 which is fixed on the housing. The circular surface 36 of the servo-piston section 37 having the smaller diameter can sit on the conical surface 35 and represents a first pressure surface on the servo-piston, which surface can be acted on, for the opening of the throttle valve 23, by the pressure prevailing in the section 28 of a consumer line which extends into the feed space 38 of a throttle valve 23. The section 33 of a consumer line is connected to the discharge space 39 of a throttle valve 23. The annular surface 40 created by the step in the servo-piston 34 and which is always at a distance from the conical surface 35 can therefore be acted on by the pressure prevailing in the section 33 of a consumer line, and it is referred to as third pressure surface. The first pressure surface and the third pressure surface of the servo-piston 34 are the same size. At the rear, the servo-piston 34 has a second pressure surface 41 which faces a control space 42 and can be acted on by a control pressure and which is exactly as large as the first pressure surface 36 and the third pressure surface 40 together.

Figure 2:
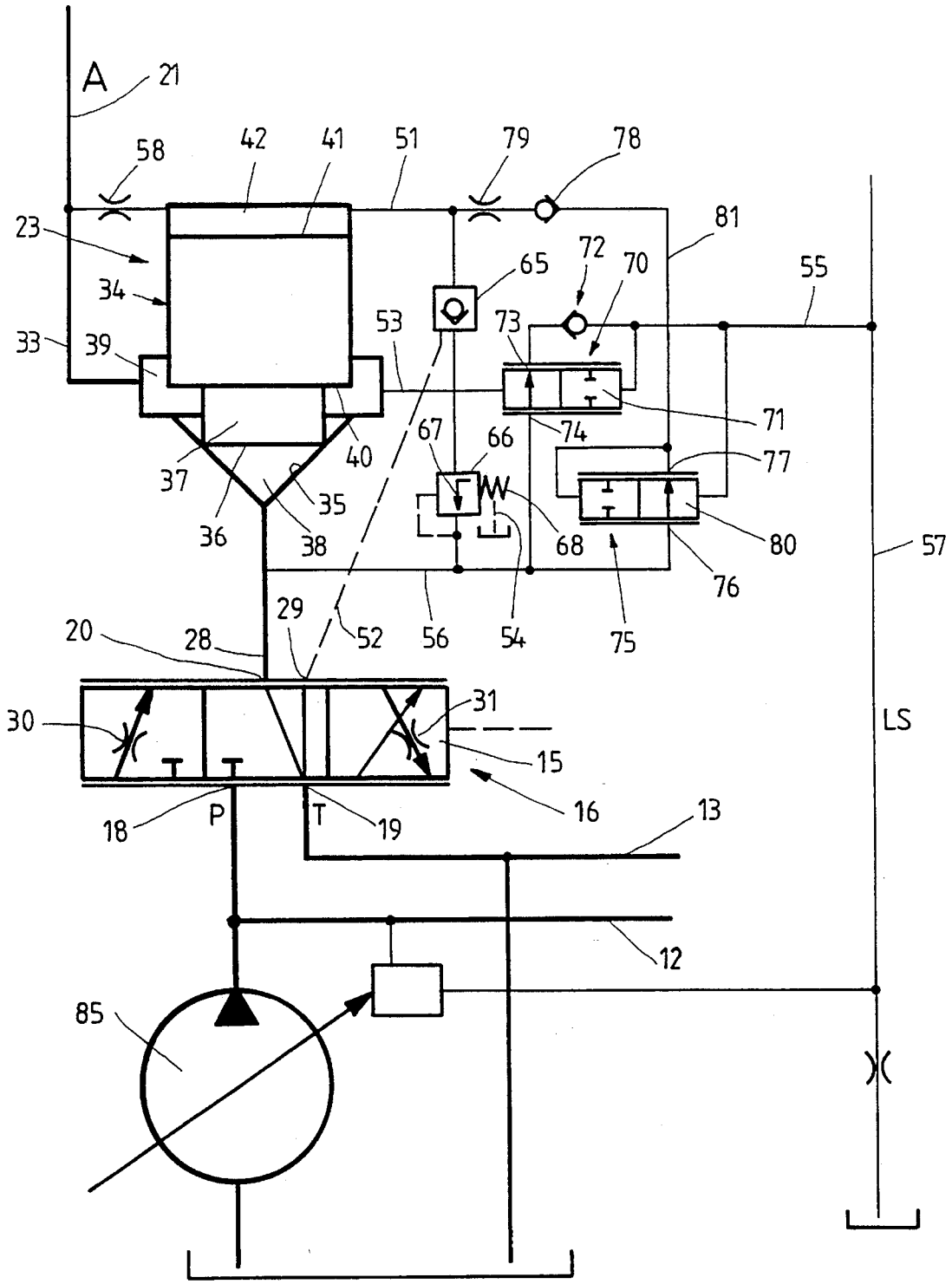
FIG. 2 shows, in detail, a portion of the circuit diagram of FIG. 1 for the control of one side of a hydraulic consumer.
Figure 3:
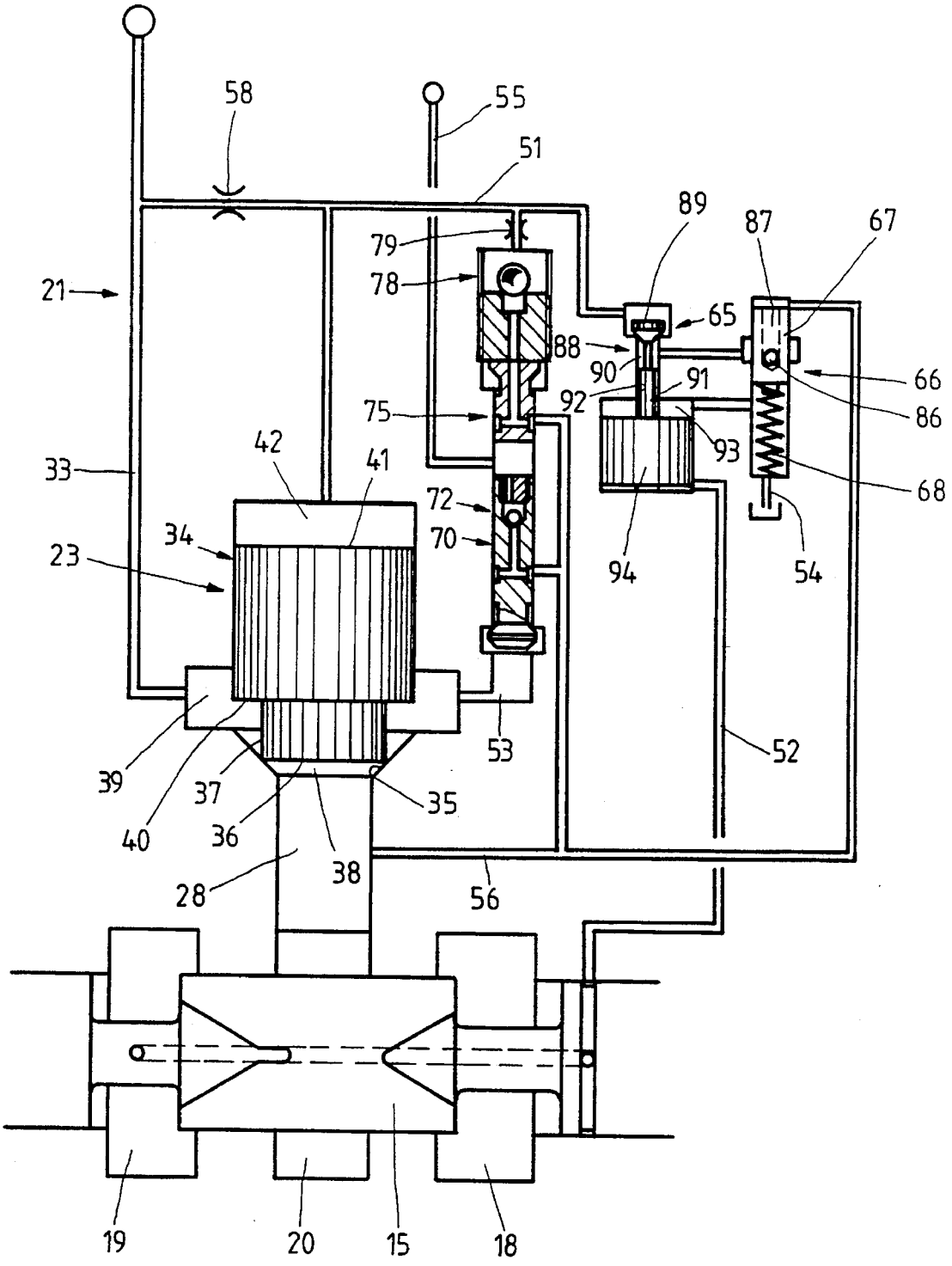
FIG. 3 shows a circuit diagram in accordance with that of FIG. 2 in which, however, the valves are shown with respect to their structural development and their spatial association with each other.
Figure 4:
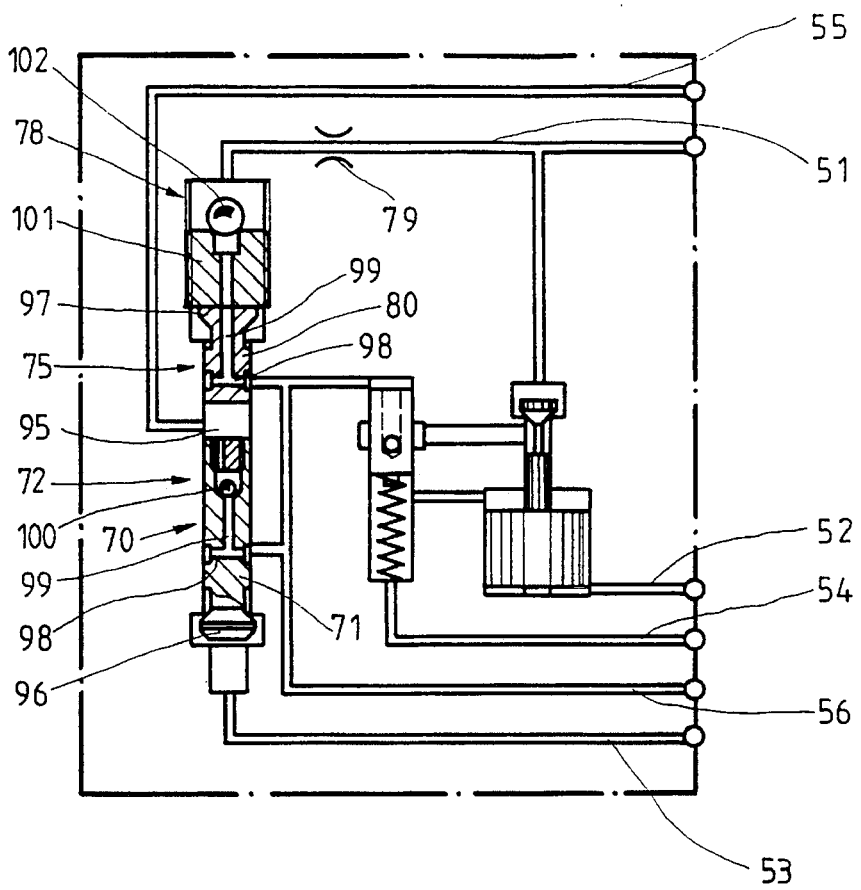
FIG. 4 shows another arrangement of individual valves of the embodiment of FIG. 3, these valves being combined to form a single structural unit.

Several servo valves which can be noted in detail in FIGS. 2, 3 and 4, are combined in FIG. 1 into a valve block 50 which is connected via six lines with other parts of the control arrangement. A first line 51 leads to the control space 42 of a throttle valve 23, a second line 52 leads from the control output 29 of a directional control valve 16 or 17, a third line 53 leads from the section 33 of a consumer line or from the discharge space 39 of the throttle Valve 23, a fourth line 54 leads from the tank line 13, a fifth line 55 leads from the load signal line 57 and a sixth line 56 leads from a section 28 of a consumer line to the valve block 50. The control space 42 is furthermore connected via a nozzle 58 with the section 33 of a consumer line. As indicated in Fig. 1, this connection can be made within the servo-piston 34 of a throttle valve 23 to the discharge space 29 or, as can be noted from FIGS. 2 and 4, it can also be made outside the servo-piston 34.

To the line 51 there is connected a non-return valve 65 which blocks towards said line but can be unblocked and which is connected with a pressure compensator 66, which is furthermore connected to the line 56. The control piston 67 of the pressure compensator 66 is acted on by a compression spring 68 in "open" direction and by the pressure prevailing in the line 56 in "close" direction. The side of the control piston 67 on which the compression spring 68 acts is connected via the line 54 to the tank. For unblocking, the non-return valve 65 is acted on by pressure via the line 52.

A 2/2 directional control valve 70 is used as a load signal valve and has a valve spool 71 which can be acted on, on its one side, via the line 53 in the direction of the opening of the load signal valve 70 by the load pressure of the corresponding consumer and on its other side in the direction of the closing of the valve by the highest load pressure of all actuated consumers which prevails in the load signal line 57. Between the work output 73 of the load signal valve 70 and the load signal line 57, a non-return valve 72 is inserted in the line 55, said valve blocking towards the work output but not affecting the action of pressure on the valve spool 71 from the load signal line 57. In other words, the corresponding control space on the spool 71 is connected, as seen from the work output 73, on the other side of the non-return valve 72 to the line 55. The work input 74 of the load signal valve 70 is connected via the line 56 with the section 28 of a consumer line.

A second 2/2 directional control valve 75, hereinafter referred to as copy valve, is connected with one work input 76, also via the line 56, with a section 28 of a consumer line. By means of a working output 77, it is connected to the control space 42 via a line 81 and via a non-return valve 78 which blocks it off towards it and a nozzle 79. The connection of the non-return valve 65 to the control space 42 is effected, as seen from the latter, in front of the nozzle 79 and the non-return valve 78. The valve spool 80 of the copy valve 75 is acted on, on the one side, in the direction of the opening of the valve by the pressure prevailing in the load signal line 57 and, on the other side, in the direction of the closing of the valve by the pressure at the work output 77.

As source of pressure for the entire control arrangement, use is made, as can be noted from FIG. 2, of a variable-displacement pump 85, which in known manner is controlled by the highest load pressure prevailing in the load signal line, by the pressure prevailing in the pump line 12, and by a force exerted by a spring element and which delivers such an amount of oil per unit of time as to maintain within the pump line 12 a pressure which, determined by the spring element, is a few bars higher than the pressure prevailing in the load signal line 57.

The structural development of the valves 65, 66, 70, 72, 75 and 78 can be noted in more detail from FIGS. 3 and 4. The control piston 67 of the pressure compensator 66 has a radial bore 86 which, depending on the position of the control piston, is open to a greater or lesser extent, and an axial blind bore 87 which is open towards an end control space into which the line 56 debouches. On the opposite side, the compression spring 68 acts on the control piston 67. The non-return valve 65 has a closures element 88 with a conical closure head 89 by means of which the closure element 88 can sit on a valve seat which is fixed on the housing, adjoining the closure head 89 an annular groove 90 and then, furthermore, a piston 91 which is guided closely in the bore 92 present below the valve seat and extends into a cylindrical hollow space 93 a cross section of which is substantially larger than the cross section which is circumscribed by the edge of the valve seat and which represents, for the pressure prevailing in the control space 2, the active blocking surface for the closing of the non-return valve 65. A connecting channel between the non-return valve 65 and the pressure compensator 66 debouches in the region of the annular groove 90 on the closure element 88 into the bore 92 and into an annular channel around the control piston 67 of the pressure compensator 66. Within the hollow space 93 there is a movable auxiliary piston 94, the one end of which can lift the closure element 88 off from the valve seat and for this can be acted on by pump pressure on its other end via the line 52. The space on the first end of the auxiliary piston 94 is connected to the line 54 via the space of the pressure compensator 66 which receives the compression spring 68.

The two valve spools 71 and 80 of the load signal valve 70 and of the copy valve 75 are located, spaced from each other, in a common housing bore 95 and each of them has at its ends remote from each other, a stop head 96 and 97 with which they extend in each case into a widened section of the bore 95. The stop head 97 of the valve spool 80 has only the function of limiting the path of insertion of the piston 80 into the narrower region of the bore 95. The stop head 97 of the valve spool 71 also has this function, but, in addition, it also serves as closure element for a double-seat valve and is therefore developed as a double frustoconical cone and can sit on two seating edges, spaced from each other, of the bore 95, which limit the widened region in which the stop head 96 is located. The line 53 is thus sealed off free of leakage oil by the stop head 96.

The two lines 55 and 56 can be connected to each other via several radial bores 98 and an axial channel 99 which opens on the end of the valve spool 71 facing the valve spool 80. In the axial channel, and therefore within the valve spool 71 there is a bore 100 as a closure element of the non-return valve 72. Via several radial bores 98 and an axial channel 99 in the valve spool 80, the line 50 can also be connected to the line 51. The non-return valve 78 is arranged in the widened section of the bore 95 in which the stop head 97 of the valve spool 80 is located, the valve seat of the non-return valve being developed on a stud screw 11 screwed therein and the closure element of which is a ball 102.

In accordance with FIG. 5, the two directional control valve pistons 15 of the two directional control valves 16 and 17 are arranged alongside of each other. Each directional control valve piston has two annular grooves 110 and 111 which are separated from each other by the annular collar 32 which bears the fine control grooves 30 and 31. The fine control grooves 30 and 31 have, as seen looking down on the axis of the valve piston 15, a substantially triangular shape, they being widest, and in radial direction also deepest, directly at the annular grooves. The fine control grooves 31 continue at their tip into a narrow recess 109 which is so long in axial direction that it extends, in the central position of rest of the directional control valve pistons 15 shown, up to an annular channel 112 which is located in the section housing 121. In this way, in the central position of the directional control valve pistons 15 the section 28 of each consumer line discharges towards the work output 19 and thus towards the tank. As already described, the line 52 is also discharged to the tank in the central position of the directional control valve piston. For this, each directional control valve piston 15 has an annular groove 113, from which a radial bore 114 extends to a longitudinal bore 115 which is present in the axis of a directional control valve piston 15 and which also debouches in the region of the annular groove 19 through a radial bore 116.

The servo-pistons of the throttle valves 23 have, in front of their surface or edge cooperating with the valve seat, a cylindrical section 117, which extends with a precise fit into a bore hole in the housing 121 and is provided with fine control grooves 118.

The combined pressure limiting and after-suction valves 24 and 25 are inserted in the housing 121 parallel to the servo-pistons 34 of the throttle valves 23.

In an embodiment of the directional control valve device with two directional control valve pistons, different nominal sizes can be used for the two pistons. Furthermore, as can be noted from FIG. 5, it is possible to extend the pump line 12 and the tank line 13 between the two directional control valve pistons 15 through the valve sections 11 and thus, in simple manner, produce both the connection of the directional control valve 16 and that of the directional control valve 17 with the pump line 12 and tank line 13 respectively. On the other hand, in the embodiment according to FIG. 6, in which a single directional control valve piston 15 is used for the flow-dividing valve device 14, connecting channels are required between the two annular channels 119 which are spaced from each other in axial direction and connected to the pump line 12 and the two annular channels 120 which are also spaced apart axially and connected to the tank line. Otherwise, the embodiment of FIG. 6 corresponds to that of FIG. 5, so that it need not be further described. It may merely be pointed out that, in the embodiment according to FIG. 6, the two annular grooves 113 of the two pistons 15 are combined to form a single annular groove 113.

Figure 7:
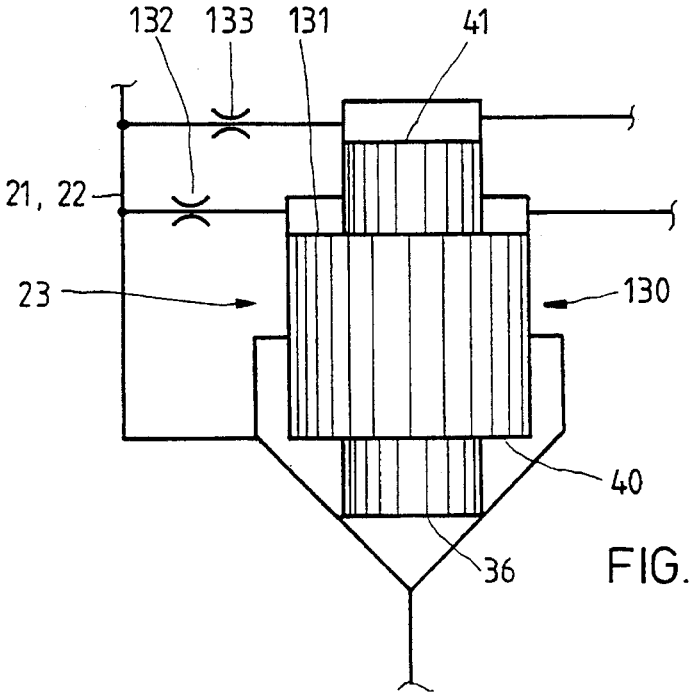
FIG. 7 shows a throttle valve with another servo-piston.

Finally, FIG. 7 shows a modified throttle valve 23 the servo-piston 130 of which is stepped both at its front and at its rear. Facing the valve seat, it has a first pressure surface 36 and a third pressure surface 40, in the same way as the servo-piston 34. The second pressure surface 41 now corresponds in its size to the pressure surface 36 and can be acted on by the highest load pressure. The control space behind the load pressure surface 41 is connected, via a nozzle 133, to the consumer line 21 and/or 22. A nozzle 79 as in the embodiment of FIGS. 1 to 6 is not present. A fourth pressure surface 131 corresponds in its size to the pressure surface 40 and is connected, via a nozzle 132, with a consumer line 21 and/or 22. The forces produced on the surfaces 40 and 131 are equal to each other, so that equilibrium can be established between the highest load pressure and the pressure prevailing on the first pressure surface 36.

For the manner of operation of the control arrangement of FIGS. 1 to 5, reference may be had now, in particular, to FIGS. 2 and 3. There is shown therein the one of two consumer lines leading to a given consumer together with the corresponding valves. The directional control valve pistons 15 of the two directional control valves 16 and 17 are in their position of rest and the consumer is therefore not actuated. The section 28 of the consumer lines 21 and 22 and the two lines 52 are discharged towards the tank. The load pressure of the consumer, even if it should be higher than that of all other consumers, cannot be given onto the load signal line 57. If the load pressure of the consumer is greater than the load pressure prevailing in the load signal line, then the valve spool 71 is pushed into the bore 95 until the one side of the stop head 96 comes against the edge of the bore. If the pressure in the load signal line is greater than the load pressure of the consumer, then the valve spool 71 of the valve 73 is pushed out of the bore 95 until the stop head 96 comes against the other seat. In both cases, the line 53 is sealed-off free of leakage oil. The non-return valve 65 is closed. The non-return valve 78 is also closed. In the control space 42 of the servo-piston 41 of the throttle valve 23 load pressure therefore prevails in the same way as in the discharge space 39, so that the servo-piston is pressed firmly against the surface 35. The section 33 of the consumer line 21 is therefore blocked free of leakage oil.

The consumer may, for instance, be one or more parallelly operated hydraulic servomotors which are used to raise and lower the shovel of a wheel loader and are connected for the raising of the shovel via the consumer line 21 to the pump line 12 and via the consumer line 22 to the tank line 13. Therefore, if the shovel is to be raised, the directional control valve piston 15 of the flow-dividing valve 16 is pushed to the right as seen in FIG. 2. If the load of the consumer is greater than the load of all other consumers actuated, its load pressure is copied via the load signal valve on the load signal valve line 57. If another actuated consumer has the highest load, then the load signal valve 70 is closed. In all cases, the pressure caused by the highest load of all consumers actuated prevails on the load signal line.

Since pressure is now produced in the section 28 of the consumer line 21, the pressure at the output 77 of the copy valve 80 increases to the highest load pressure. The non-return valve 78 is opened and, via the two nozzles 58 and 79, there is established within the control space 42 a pressure which lies precisely in the middle between the load pressure of the consumer and the highest load pressure. The throttle valve 23 therefore opens and the consumer can be moved. If the load of the consumer changes, then the pressure in the section 28 of the consumer line also changes, and thus the pressure acting on the first pressure surface 36 of the servo-piston 34. There is produced on the servo-piston 34 an imbalance of forces which has the result that the servo-piston 34 opens somewhat further upon an increase of the load pressure and closes somewhat further upon a decrease of the load pressure until the equilibrium of forces is again restored. The pressure drop over the metering restrictor 30 is thereby maintained constant so that, regardless of the load, the consumer is always moved with the same speed in case of a given position of the directional control valve piston 15.

If the highest load pressure prevailing in the load signal line 57 changes, then the pressure in the pump line 12 changes accordingly. Since the load pressure of the consumer is unchanged, the total pressure gradient over the metering restrictor 30 and the throttle valve 23 becomes greater or smaller, so that the pressure in the section 28 of the consumer line 21 also changes. The pressure in the control space 42 also changes, but less so than the pressure in the line section 28. An imbalance of forces is produced on the servo-piston 34 which is eliminated upon a decrease of the highest load pressure by a further opening, and upon an increase of the highest load pressure by a further closing of the throttle valve 23. The pressure drop over the metering restrictor 30 thus remains constant.

If the highest load pressure of all other actuated consumers drops below the load pressure of the consumer in question, then the load signal valve 70 opens and the load pressure of the consumer in question is copied on the load signal line.

For the lowering, for instance, of the shovel of a wheel loader, the directional control valve piston 15 is moved in the opposite direction. In this way, the section 28 of the consumer line 21 is discharged towards the tank. The non-return valve 65 is unblocked, so that hydraulic fluid can flow into the tank line 13 from the control space 42 via the pressure balance 66. A very small nominal size is selected for the nozzles 58 and 79. Pressure compensator 66 and nozzle 58 are furthermore so adapted to each other that, with the pressure compensator entirely open, the pressure drop over the nozzle 58 is greater than half the load pressure. The load pressure acting on the pressure surface 40 can therefore open the throttle valve 23. By changing the position of the control piston 67, the control pressure in the pressure space 42 can be controlled. The control piston assumes such a position that the control pressure acting on the control surface 41, the load pressure acting on the pressure surface 40, and the pressure present in front of the metering restrictor 31 and in the line section 28 and acting on the pressure surface 36 bring the servo-piston 34 into a position of equilibrium in which the pressure drop over the metering restrictor 31 corresponds to the force of the compression spring 68 of the pressure compensator 66. If the load pressure increases, then the pressure in front of the metering restrictor 31 also increases and the control piston 67 of the pressure compensator 66 moves in the direction of closing. As a result, the pressure in the control space 42 increases and the throttle valve 23 closes until the old pressure again prevails again in front of the metering restrictor 31. The throttle valve 23 is opened further in corresponding manner upon a drop in the load pressure.

In the embodiment shown in FIG. 7, in the one operating position of the directional control valve device in which the line 21 is connected to the pump 85, the load pressure is present on the pressure surface 131, and the highest load pressure is present on the pressure surface 41.

In the central position of a directional control valve piston, load pressure is present both on the pressure surface 131 and on the pressure surface 41.

In the other operating position of a directional control valve piston, the two pressure spaces behind the pressure surfaces 41 and 131 are discharged via, in each case, an openable non-return valve 65 and via a pressure compensator 66, and identical or different control pressures are established which make it possible to hold the servo-piston in each case in equilibrium conditions under which the pressure drop over the restrictor 31 is constant.

I claim:

1. A control arrangement for at least one hydraulic consumer in which a consumer can be controlled with respect to direction and speed via a directional control valve device, in which two consumer lines lead from the directional control valve device to the consumer, each of which consumer lines can be connected via a directional control valve piston and a metering restrictor to a pump and via a directional control valve piston and preferably a metering restrictor to a tank respectively and each has, associated therewith, a throttle valve having a servo-piston, wherein the servo-piston of the throttle valve is arranged in the consumer line downstream of the directional control valve piston and the metering restrictor; a valve seat can be acted on by the servo-piston; the servo-piston has at its front a first pressure surface which, for opening of the throttle valve, can be acted on by pressure prevailing downstream of the directional control valve device and the metering restrictor, at its rear a second pressure surface which, for closing of the throttle valve, can be acted on by a control pressure produced in a position of rest of the directional control valve piston alone by a load, and at its front, a third pressure surface which, for the opening of the throttle valve, can be acted on by load pressure prevailing in the corresponding consumer line between the throttle valve and consumer; and upon a discharg of the corresponding consumer line to the tank, the pressure acting on the second pressure surface can be reduced.

2. A control arrangement according to claim 1, wherein the control pressure on the rear second pressure surface with the consumer line connected to the pump is at least as large as the load pressure and upon discharg of the consumer line to the tank can be reduced to a level below the load pressure, and preferably to such a value, dependent on the load pressure, that by an automatic change of the position of the servo-piston of the throttle valve the pressure drop over a metering restrictor of the directional control valve device remains constant upon varying load pressure.

3. A control arrangement according to claim 1, wherein the servo-piston has a cylindrical section with at least one fine control groove.

4. A control arrangement according to claim 1, wherein the control pressure is generated corresponding to the sizes of the pressure surfaces in such a manner from the load pressure of the corresponding consumer and the highest load pressure of several consumers that a balancing of forces is adjustable on the servo-piston.

5. A control arrangement according to claim 1, wherein the servo-piston is a stepped piston, of which the rear second pressure surface is exactly as large as the first pressure surface and the third pressure surface together.

6. A control arrangement according to claim 4, wherein in order to generate the control pressure, a control space limited by the rear second pressure surface is connected, via a first nozzle with a line which is acted on by the load pressure and, via a second nozzle, with a line which is acted on by the maximum load pressure.

7. A control arrangement according to claim 6, wherein the first pressure surface and the third pressure surface are of the same size and that the first nozzle and the second nozzle are two identical nozzles.

8. A control arrangement according to claim 1, wherein: the servo-piston has, at its rear, the second pressure surface and a fourth pressure surface; the fourth pressure surface is just as large as the third pressure surface and can be acted on, for the closing of the throttle valve, by the load pressure; the second pressure surface is just as large as the first pressure surface and can be acted on by a maximum load pressure; and the pressure in the control space behind the second pressure surface and in a control space behind the fourth pressure surface can be reduced upon discharge of the corresponding consumer line to the tank.

9. A control arrangement according to claim 1, wherein a control space behind the servo-piston can be discharged via an openable non-return valve.

10. A control arrangement according to claim 9, wherein a closure element of the non-return valve can be lifted from the valve seat by an auxiliary piston; the auxiliary piston has a control surface which can be acted on by control pressure and is substantially larger than a blocking surface on the closure element; and the last mentioned control pressure is preferably pump pressure.

11. A control arrangement according to claim 10, wherein the control space behind the control surface of the auxiliary piston can be discharged to the tank in the position of rest of the directional control valve device.

12. A control arrangement according to claim 9, wherein between the non-return valve and a section of the consumer line which lies between the directional control valve device and the throttle valve, there is inserted a pressure compensator, a control piston of which can be acted on in one direction by pressure in said section of the consumer line and in the other direction by a spring.

13. A control arrangement according to claim 9, wherein the non-return valve connected to the two nozzles, to the control space of the throttle valve.

14. A control according to claim 4, further comprising a load signal valve having a work input which can be connected with a consumer line between the directional control valve device and the throttle valve, having a work output which is connected to a load signal line, having a first control input which is connected to the consumer line between said throttle valve and consumer, and having a second control input which is connected to the load signal line or coincides with the work output.

15. A control arrangement according to claim 14, wherein the load signal valve has a valve spool as a seat valve, in particular a double-seat valve.

16. A control arrangement according to claim 15, wherein the valve spool has a piston head of larger diameter which can be acted on by pressure in the first control input and pressed against a seat.

17. A control arrangement according to claim 15, wherein a channel for the work fluid extends from one end of the valve spool which can be acted on by the pressure in the load signal line.

18. A control arrangement according to claim 14, wherein a non-return valve which blocks off from the consumer line is arranged in the connection from the consumer line to the load signal line.

19. A control arrangement according to claim 18, wherein the non-return valve is integrated in the valve spool of the load signal valve.

20. A control arrangement, in particular according to claim 4, further comprising a copy valve having a work input which is connected to a consumer line between the directional control valve device and the throttle valve, having a work output which is connected to a control space behind the servo-piston of the throttle valve, having a first control input which is connected to the load signal line, and having a second control input which is connected to the work output or coincides with it.

21. A control arrangement according to claim 20, wherein the copy valve has a valve spool with control surfaces, and a non-return valve is arranged in the connecting line between the valve spool and a control space behind the servo-piston of the throttle valve.

22. A control arrangement according to claim 21, wherein a channel for the working fluid extends from one end of the valve spool which can be acted on by the pressure at the work output.

23. A control arrangement according to claim 14, further comprising a copy valve having a work input which is connected to a consumer line between the directional control valve device and the throttle valve, having the work output which is connected to a control space behind the servo-piston of the throttle valve, having a first control input which is connected to the load signal line, and having a second control input which is connected to the work output or coincides therewith, and a valve spool of the load signal line and a valve spool of the copy valve are contained in a same housing bore, and the load signal line debouches into a housing bore between the two valve spools.

24. A control arrangement according to claim 23, wherein each of the valve spools has a head of larger diameter by which a path of immersion into the bore is limited.

25. A control arrangement according to claim 8, further comprising a load signal valve having a work input which can be connected with a consumer line between the directional control valve device and the throttle valve, having a work output which is connected to a load signal line, having a first control input which is connected to the consumer line between said throttle valve and consumer, and having a second control input which is connected to the load signal line or coincides with the work output.

26. A control arrangement according to claim 25, wherein the load signal valve has a valve spool with which the first control input can be closed off from work connections in the manner of a seat valve, in particular a double-seat valve.

27. A control arrangement according to claim 26, further comprising a valve spool which has a piston head of larger diameter which can be acted on by pressure in the first control input and pressed against a seat.

28. A control arrangement according to claim 26, further comprising a channel for a working fluid which extends from one end of a valve spool which can be acted on by pressure in the load signal line.

29. A control arrangement according to claim 25, wherein a non-return valve which blocks off from the consumer line is arranged in the connection from the consumer line to the load signal line.

30. A control arrangement, according to claim 8, further comprising a copy valve having a work input which is connected to a consumer line between the directional control valve device and the throttle valve, having a work output which is connected to a control space behind the servo-piston of the throttle valve, having a first control input which is connected to the load signal line, and having a second control input which is connected to the work output or coincides therewith.

31. A control arrangement according to claim 30, wherein the copy valve has a valve spool with control surfaces, and a non-return valve is arranged in connecting line between the valve spool and a control space behind the servo-piston of the throttle valve.

32. A control arrangement according to claim 31, wherein a channel for the working fluid extends from one end to the valve spool which can be acted on by pressure at the work output.

* * * * *